United States Patent [19]

Albanese

[11] 4,177,043

[45] Dec. 4, 1979

[54] CHEMICAL TREATMENT FOR IMPROVING ELECTROSTATIC PRECIPITATION OF DUST PARTICLES IN ELECTROSTATIC PRECIPITATORS

[75] Inventor: Vincent M. Albanese, Lockport, Ill.

[73] Assignee: Nalco Chemical Company, Oak Brook, Ill.

[21] Appl. No.: 908,313

[22] Filed: May 22, 1978

[51] Int. Cl.[2] ..... B03C 1/00

[52] U.S. Cl. ..... 55/5

[58] Field of Search ..... 55/5

[56] References Cited

U.S. PATENT DOCUMENTS

| | | | |
|---|---|---|---|
| 1,291,745 | 1/1919 | Bradley | 55/5 |
| 2,381,879 | 8/1945 | Chittum | 55/5 |
| 3,600,653 | 8/1971 | Hall | 55/5 |
| 4,043,768 | 8/1977 | Bennett et al. | 55/5 |

*Primary Examiner*—Bernard Nozick

*Attorney, Agent, or Firm*—John G. Premo; Robert A. Miller

[57] ABSTRACT

A method for the electrostatic precipitation of dust particles entrained in a gas stream which comprises adding small amounts of a treatment chemical into the particle-laden gas stream in a location preceding the precipitation apparatus where the gas is at an elevated temperature. The treatment chemical comprises a blend of ammonium sulfate and triethylamine sulfate combined in a weight ratio of from 12:1–0.5:1.

2 Claims, No Drawings

CHEMICAL TREATMENT FOR IMPROVING ELECTROSTATIC PRECIPITATION OF DUST PARTICLES IN ELECTROSTATIC PRECIPITATORS

INTRODUCTION

Description of the Prior Art

A conventional way of separating dust particles from a gas stream in which the particles are entrained is by the use of an electrostatic precipitator. This apparatus utilized the corona discharge effect, i.e. the ionization of the particles by passing them through an ionization field established by a plurality of discharge electrode wires suspended in a parallel plane with a grounded collecting electrode plate. The ionized particles are attracted to the collector plate from which they may be removed by vibrating or rapping the plate. Examples of this type precipitator are found in Cummings' U.S. Pat. No. 3,109,720 and Pennington U.S. Pat. No. 3,030,753.

Dust particles have different characteristics depending upon their source. One characteristic is resistivity which is measured in ohm-centimeters. For example, where the source of particles is a coal-fired boiler, there is usually a predictable relationship between the type of coal burned and the resistivity of the particles. Typically, low sulfur coal, i.e. less than 1% sulfur, produces particles having high resistivity, i.e. $10^{+13}$ ohm-centimeters resistance; coal with 3–4% sulfur produces particles having $10^{+8}$–$10^{+10}$ ohm-centimeters resistance; and, poorly combustible coal produces particles having $10^{+4}$–$10^{+5}$ ohm-centimeters resistance.

It has been found that most efficient separation of precipitation of the particles occurs when their resistivity is about $10^{+8}$–$10^{+10}$ ohm-centimeters. When the resistivity is higher than this, the precipitation process is encumbered because the particles tend to hold their charge; particles collected on the plate in a layer tend to remain negatively charged and particles subsequently charged in the gas stream are not attracted to the plate with a resultant loss of efficiency. Conversely, when the resistivity is lower than this, the low resistivity particles lose their charge rapidly upon contact with the collector plate thereby being difficult to retain thereon; reentrainment then occurs with a resultant loss of efficiency. However, when the particles are of the preferred resistivity, a balance is achieved between the tendency to have either overcharged or undercharged particles with a resultant increase in precipitation efficiency. Thus, the problem which existed until now was to provide a means for reducing the resistivity of high-resistivity particles and increasing the resistivity of low-resistivity particles.

THE INVENTION

The electrostatic removal of high-resistivity particles entrained in a gas stream in the 500° F. (800°–1400° F.) temperature range can be improved by the addition to such gas stream of preselected amounts of a treatment chemical which comprises a blend of ammonium sulfate and triethylamine sulfate combined in a weight ratio of 12:1–0.5:1. The ratio is, preferably, 1:1–9:1. The treatment chemical also can enhance the electrostatic removal of high resistivity dust particles in the normal cold-side precipitator range of 250°–350° F. The amount of treatment chemical that is effective in decreasing the resistivity of the dust particles may vary.

Most coals upon combustion generate from 5–20% of their precombustion weight in the form of fly ash. The composition of this invention is generally used in an amount ranging from 0.125–3.0% by weight based upon the fly ash present in the flue gas or the like. Preferably, the chemical which is the subject of this invention is added to the flue gas at a rate of from 0.125–2.0% by weight of the fly ash, and most preferably, the chemical is added to the flue gas at a level equivalent to 0.25–0.5% by weight based upon the weight of the fly ash.

The ammonium sulfate-triethylamine sulfate combination is generally added in the form of an aqueous solution. Due to the handling considerations as well as solubility factors, the aqueous solutions employed will generally contain from 10–50% by weight of the composition of this invention. The use of aqueous solutions of the material allow the ingredients to be sprayed onto the flue gas.

Evaluation of the Invention

To evaluate the effectiveness of the treatment chemical as a gas treating aid to improve electrostatic precipitator performance, the following test method was used.

ASME Power Test Code 28, which is described in the December, 1972 issue of *Power Engineering* in an article by W. E. Archer, was one test method utilized for determining fly ash bulk electrical resistivity. Briefly, this test entailed:

1. placing a treated ash sample in a conductivity cell maintained at approximately 300° F.;
2. lowering an electrode onto the surface of the ash sample;
3. applying a constant value of 2kv/cm to the cell and measuring current through the ash sample;
4. calculating the resistivity of the ash sample by relying on the voltage and current readings;
5. applying increased voltages to the cell while observing the current through the ash sample until electrical breakdown of the sample layer occurred; and
6. calculating resistivity by relying on the voltage and current readings in the range of 85–95% of the breakdown voltage.

The treated ash sample was prepared by slurrying the fly ash in a small amount of water, adding the treatment chemical and heating to drive off the water.

On fly ash that, untreated, gives rise to a resistivity of from $1.2\times10^{12}$ ohm-cm., the addition of 2.0% by weight of a product comprising a 9:1 ratio of ammonium sulfate to triethylamine sulfate based on the weight of the fly ash, reduced resistivity to $3.5\times10^{9}$ ohm-cm. The same dosage by weight of ammonium sulfate reduced resistivity of the ash to $2.1\times10^{11}$ ohm-cm. Triethylamine by itself fed at the same dosage produced a resistivity of $1.3\times10^{12}$ a figure being within experimental error of the untreated material. Triethylmaine sulfate fed at the same dosage generated resistivity of $8.4\times10^{11}$, a modest decrease in resistivity.

Tests were run on a sample of high resistivity fly ash generated from a low sulfur coal which consisted mostly of silica and alumina. The test employed the procedure found on page 4 of this specification utilizing a temperature of 310° F., 1% humidity and 2.0 kv/cm at a constant field strength. Utilizing dosage of 2.0% based on the weight of fly ash the readings as found on Table I were obtained.

TABLE I

| Treatment | Resistivity |
|---|---|
| Untreated | $2.0 \times 10^{12}$ ohm-cm. |
| 9:1 combination $(NH_4)_2SO_4$:triethylamine sulfate | $8.5 \times 10^{9}$ ohm-cm. |
| 1:1 combination $(NH_4)_2SO_4$:triethylamine sulfate | $1.7 \times 10^{10}$ ohm-cm. |
| $(NH_4)_2SO_4$ | $7.0 \times 10^{10}$ ohm-cm. |
| Triethylamine sulfate | $8.4 \times 10^{11}$ ohm-cm. |

In situ resistivity measurements utilizing a point plane probe were taken in a commercial coal fired flue gas. The probe showed no change in resistivity as treatment was applied. ($6.8\times10^9$ ohm-cm. vs $7.2\times10^9$ ohm-cm.) The base line determinations showed that the fly ash already was of a precipitable resistivity ($6.8\times10^9$ ohm-cm.), and the treatment level that was applied, (less than 0.2% by weight of the fly ash), did not lower this figure. However, a grab sample from the precipitator showed a resistivity of $4.5\times10^{11}$ ohm-cm. without treatment vs $1.3\times10^{11}$ ohm-cm. with treatment.

While this difference is not appreciable, the treatment rate was extremely low. The apparent differentiation for the in situ vs grab determinations were that the gaseous atmosphere in the laboratory did not have the $SO_2$ or water content that approximates flue gas.

I claim:

1. A method of improving the conductivity of fly ash particles entrained in a stream of particle-laden gas formed by the burning of coal, which fly ash particles are collected by an electrostatic precipitator which comprises treating said particles prior to their precipitation in an electrostatic precipitator with a treatment chemical comprising ammonium sulfate plus triethylamine sulfate combined in a weight ratio of 0.5–12:1 said treatment chemical being added at a level of from 0.125–2.0% by weight of the fly ash present in said particle laden gas.

2. The method of claim 1 where the weight ratio is 1:1 to 9:1.

* * * * *